United States Patent [19]

Rasmussen

[11] 4,007,506

[45] Feb. 15, 1977

[54] SWIM FIN

[76] Inventor: Philip A. Rasmussen, 269 Pacific Ave., Solana Beach, Calif. 92075

[22] Filed: Dec. 18, 1975

[21] Appl. No.: 642,076

[52] U.S. Cl. ..... 9/309
[51] Int. Cl.[2] ..... A63B 31/10
[58] Field of Search ..... 9/301, 302, 304, 305, 9/308, 309

[56] References Cited

FOREIGN PATENTS OR APPLICATIONS

| | | | |
|---|---|---|---|
| 511,942 | 1/1955 | Italy | 9/309 |
| 1,344,379 | 11/1963 | France | 9/309 |

*Primary Examiner*—Trygve M. Blix
*Assistant Examiner*—Jesus D. Sotelo
*Attorney, Agent, or Firm*—Charles C. Logan, II

[57] ABSTRACT

A swim fin having a foot portion and a blade portion. The blade portion includes a plurality of transversely spaced longitudinally extending ribs that are connected to each other by a web member. The ribs are comprised of a plurality of elongated flexible members juxtaposed upon each other with the elongated members being inherently biased to a relatively straight condition interlocking tangs and grooves on the juxtaposed elongated members prevent lateral separation of the members. A pin passing transversely through the elongated members acts to limit the longitudinal displacement of one elongated member with respect to another. The mating surfaces of the juxtaposed elongated members have a relatively low coefficient of friction that allows the elongated members to slide relatively effortlessly with respect to each other in the longitudinal direction when the blade portion of the swim fin is subjected to forces during the swimming kick stroke that causes the elongated flexible members to undergo a reverse curvature.

9 Claims, 7 Drawing Figures

SWIM FIN

BACKGROUND OF THE INVENTION

This invention relates to swim fans that are commonly used when skin-diving or scuba diving. The reason for using a swim fin is to obtain a greater propulsive effect than is obtainable with the human foot alone. The swim fins generally consist of a foot portion to receive the swimmer's foot, plus a blade portion which forms a forward extension of the foot portion. The blade portion increases by several times the area of surface that reacts against the water and thus propels the swimmer by reaction.

In the past, most swim fans have been made of rubber with the blade portion being flexible so that it would bend in the direction opposite to which the fin is traveling. Later models of swim fans have been designed with water-flow channels on the blade portion to increase the thrust developed from the fin during the driving stroke of the swimmer's leg kick. As always, man continues to desire even greater performance from improved swim fins.

It is an object of the present invention to provide a swim fin having an improved blade portion structure.

It is also an object of the invention to provide a swim fin whose structure allows the flexible blade portion to develop a reverse curve configuration during the kicking stroke.

It is a further object of the invention to provide a swim fin whose configuration during the kicking stroke produces an accelerating surface along the blade portion for the water being displaced rearwardly.

SUMMARY OF THE INVENTION

The novel swim fin structure has the usual foot portion and blade portion. A plurality of transversely spaced longitudinally extending ribs connected to each other by a web member form the blade portion. These ribs are comprised of a plurality of elongated flexible members juxtaposed upon each other with these elongated members being inherently biased to a relatively straight condition. There are interlocking tangs and grooves on the juxtaposed elongated members to prevent their lateral separation. Pins pass transversely through the elongated members to limit the longitudinal displacement of one elongated member with respect to another. Alternatively glue or another type of adhesive can be substituted for the pins to accomplish the same result. The mating surfaces of the juxtaposed elongated members have a relatively low coefficient of friction that allows the elongated members to slide relatively effortlessly with respect to each other in the longitudinal direction. This sliding action occurs when the swim fin is subjected to forces during the swimming kick stroke that causes the elongated resilient members to undergo a reverse curvature. The reverse curvature results from the fact that the ends of the flexible members cannot move with respect to each other and when one end of the rib is bent into a curve, the opposite end of the rib has to form a curve in the reverse direction.

DESCRIPTION OF THE PREFERRED EMBODIMENT

Figure 1:
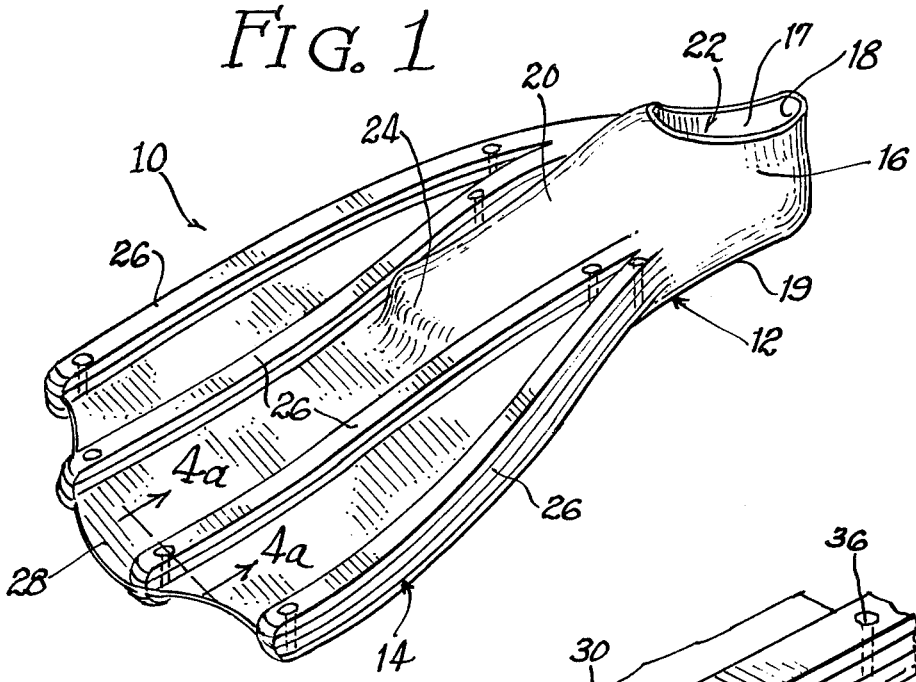
FIG. 1 is a perspective view of the swim fin.

Referring to the drawings, the structure of the novel swim will now be described. In FIG. 1, the swim fin, generally designated numeral 10, is illustrated in a perspective view. It is comprised of the foot portion 12 and the blade portion 14.

The foot portion 12 includes two side walls 16 and 17, a heel 18, a sole 19, and an upper wall 20. The side walls 16, 17, the heel 18 and the upper wall 20 together define an opening 22 into which the swimmer inserts his foot. The side walls 16, 17, the sole 19, and the upper wall 20 together define an elongated internal chamber to receive and enclose the whole of the swimmer's foot forward of the ankle, this chamber terminating forwardly at the position indicated by the ridge 24.

Figure 2:
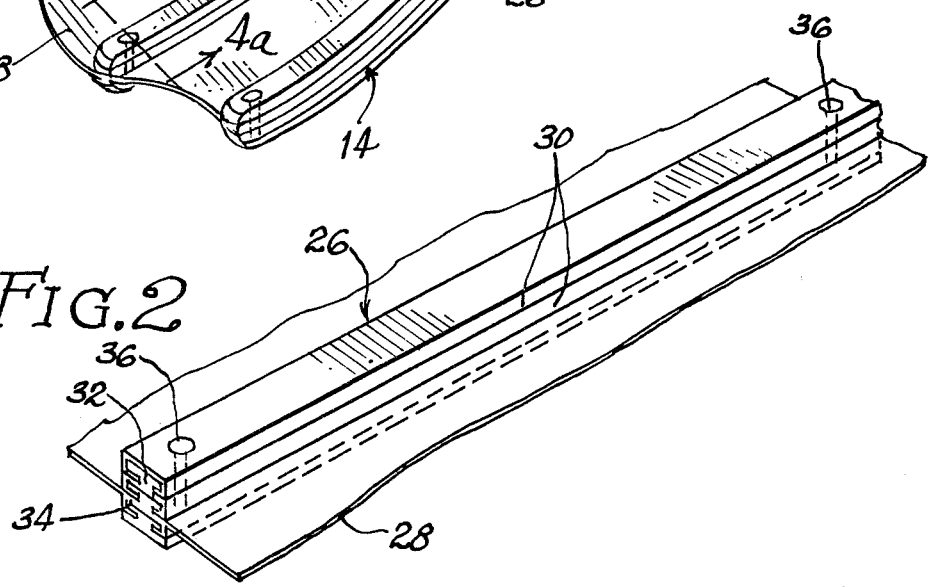
FIG. 2 is an isolated perspective view illustrating how the stacked elongated flexible members of the swim fin ribs appear in their straight state.
Figure 3:
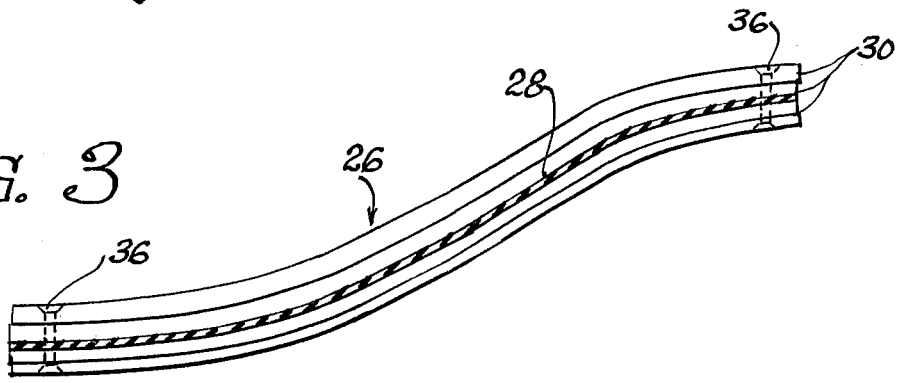
FIG. 3 is an isolated side elevational view illustrating how the stacked elongated flexible members of the swim fin ribs appear in a curved state.
Figure 4A:
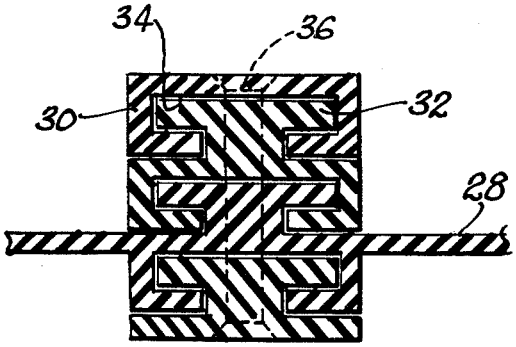
FIG. 4*a* is a sectional view taken along line 4*a*—4*a* of FIG. 1.

The blade portion 14 comprises a plurality of transversely spaced longitudinally extending ribs 26 connected to each other by a web member 28. The ribs are made up of a plurality of elongated flexible members 30 juxtaposed upon each other as best illustrated in FIGS. 2 and 3. The elongated members 30 are inherently biased in a relatively straight condition such as seen in FIG. 2. Interlocking tangs 32 and grooves 34 on the juxtaposed elongated members prevent their lateral separation (see FIGS. 4*a* and 4*b*). Pins 36 pass transversely through the elongated members 30 to limit longitudinal displacement of one elongated member with respect to another. Alternatively, glue or another type of adhesive can be substituted for the pins to accomplish the same result. As illustrated, the web 28 would preferably be formed integrally with one of the elongated members 30, although this is not mandatory.

Figure 4B:
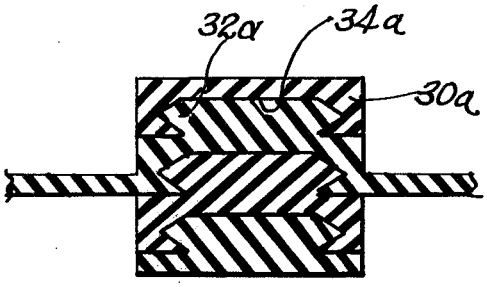
FIG. 4*b* is a cross-section illustrating an alternative embodiment with different interlocking structure on the elongated resilient members.

The elongated members 30 may be made of plastic (such as, for example, polyurethane or polyvinylchloride), metal (for example, stainless steel), rubber, or other suitable materials. It is only necessary that they be flexible, relatively incompressible, and have mating surfaces with a relatively low coefficient of friction that will allow the elongated members to slide relatively effortlessly with respect to each other in the longitudinal direction. FIG. 4*b* illustrates an alternative configuration that the tang 32*a*, groove 34*a* and elongated members 30*a* may take. It is to be understood that the configuration of the interlocking means is merely illustrative and in no way is it meant to limit the design of tangs and recesses to be utilized by the novel swim fins since there are numerous configurations that would function in the same manner and perform well. The rib could be encapsulated in another version of the swim fin, however, in this embodiment walls or a housing would have to surround the flexible members to prevent the encapsulating material from restricting the travel of one flexible member with the next.

Figure 5:
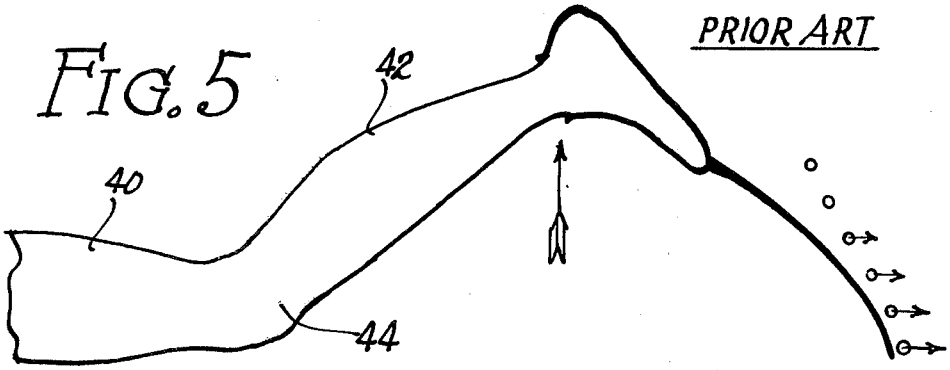
FIG. 5 PRIOR ART
FIG. 5 is a schematic diagram illustrating the manner in which prior art swim fins function during an upward stroke by the swimmer's leg.

In FIG. 5, a prior state of the art swim fin is illustrated. During the upward stroke, the leg 40 as a whole moves upwardly, and the lower limb 42 moves relatively further by pivoting about the knee joint 44. As this is happening, the flexible blade portion of the fin is bent downwardly in a direction opposite to the direction that the foot is traveling. The water adjacent the bottom of the blade portion is pressed against to give the swimmer a forward thrust. The arrows represent the force exerted by the blade portion against the water.

FIG. 3 depicts, in a side elevational view, the manner in which the elongated members 30 of the ribs assume a reverse curvature when one end of the rib is bent into a curve. This is the same reaction that is produced during the act of swimming.

Figure 6:
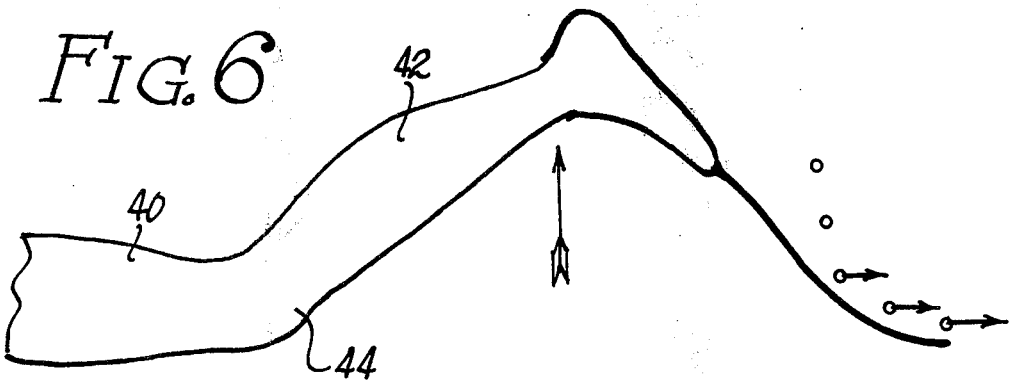
FIG. 6 is a schematic diagram illustrating the manner in which the inventor's novel swim fin functions during an upward stroke by the swimmer's leg.

By looking at FIG. 6, it can be seen how the flexible blade portion of the novel swim fins assumes a reverse curvature during the upward kicking stroke of the swimmer's leg. The arrows represent the force exerted by the blade portion against the water and indicate that an accelerated rate of flow results from the water passing over the reverse curvatures surface of the blade.

I claim:

1. A swim fin comprising:

a foot portion and a blade portion, said blade portion including a plurality of transversely spaced longitudinally extending ribs that are connected to each other by web means said ribs having means that produce a reverse curvature in their configuration when one end of the rib is bent into a curve, said means comprising a plurality of elongated members juxtaposed upon each other.

2. A swim fin as recited in claim 1, wherein said elongated members are made of flexible material.

3. A swim fin as recited in claim 1, wherein said elongated members are inherently biased to a relatively straight condition.

4. A swim fin as recited in claim 1, wherein said web means is integrally formed with one of the elongated members.

5. A swim fin as recited in claim 1, further comprising means to limit longitudinal displacement of one elongated member with respect to another.

6. A swim fin as recited in claim 1, further comprising interlocking means on said elongated members preventing lateral separation thereof.

7. A swim fin as recited in claim 6, wherein said interlocking means are in the form of a tang on one elongated member that interlocks with a groove formed in the juxtaposed elongated member.

8. A swim fin as recited in claim 5, wherein said means to limit longitudinal displacement comprises one or more pins passing transversely through the elongated members.

9. A swim fin as recited in claim 1, wherein the mating surfaces of the juxtaposed elongated members have a low coefficient of friction that allows the elongated members to slide relatively effortlessly with respect to each other in the longitudinal direction.

* * * * *